US009447793B2

(12) United States Patent
Korupp et al.

(10) Patent No.: US 9,447,793 B2
(45) Date of Patent: Sep. 20, 2016

(54) CENTRIFUGAL PUMP AND IMPELLER PROTECTOR FOR CENTRIFUGAL PUMP

(71) Applicant: Herborner Pumpenfabrik J.H. Hoffmann GmbH & Co. KG, Herborn (DE)

(72) Inventors: Sascha Korupp, Werdorf (DE); Lars Runte, Dillenburg-Frohnhausen (DE); Felix Hees, Giessen (DE)

(73) Assignee: Herborner Pumpenfabrik J.H. Hoffmann GmbH & Co. KG, Herborn (DE)

( * ) Notice: Subject to any disclaimer, the term of this patent is extended or adjusted under 35 U.S.C. 154(b) by 449 days.

(21) Appl. No.: 14/021,058

(22) Filed: Sep. 9, 2013

(65) Prior Publication Data

US 2014/0072424 A1 Mar. 13, 2014

(30) Foreign Application Priority Data

Sep. 7, 2012 (DE) ..... 10 2012 108 357

(51) Int. Cl.

| | |
|---|---|
| ***F04D 29/24*** | (2006.01) |
| ***F04D 29/42*** | (2006.01) |
| ***F04D 29/02*** | (2006.01) |
| ***F04D 29/16*** | (2006.01) |

(52) U.S. Cl.

CPC ..... *F04D 29/4286* (2013.01); *F04D 29/026* (2013.01); *F04D 29/167* (2013.01); *F05D 2260/95* (2013.01); *F05D 2300/43* (2013.01); *F05D 2300/432* (2013.01)

(58) Field of Classification Search

CPC . F04D 29/026; F04D 29/167; F04D 29/4286
See application file for complete search history.

(56) References Cited

U.S. PATENT DOCUMENTS

| | | | | | |
|---|---|---|---|---|---|
| 3,512,788 | A * | 5/1970 | Kilbane | F04D 29/167 | 277/433 |
| 4,913,619 | A * | 4/1990 | Haentjens | F04D 29/167 | 415/172.1 |
| 4,923,124 | A * | 5/1990 | Wiley | B02C 19/005 | 241/18 |
| 4,948,336 | A * | 8/1990 | Mosure | F04D 29/126 | 277/411 |
| 5,567,132 | A * | 10/1996 | Dupuis | F04D 29/061 | 277/394 |
| 5,921,748 | A * | 7/1999 | Frater | F04D 29/167 | 415/128 |
| 6,234,748 | B1 | 5/2001 | Brown et al. | | |
| 6,322,335 | B1 * | 11/2001 | Shi | F04D 29/0413 | 415/172.1 |

FOREIGN PATENT DOCUMENTS

| | | | | |
|---|---|---|---|---|
| DE | 26 04 133 | 8/1976 | | |
| DE | 81 15 273 | 8/1981 | | |
| DE | 37 08 956 | 3/1988 | | |
| GB | 2213541 A * | 8/1989 | ..... | F04D 29/126 |

* cited by examiner

*Primary Examiner* — Igor Kershteyn
(74) *Attorney, Agent, or Firm* — Clark & Brody

(57) ABSTRACT

The invention relates to a centrifugal pump (1) that has a suction-side inlet (3) and at least one pressure-side outlet (4), wherein a rotatably mounted impeller (5) for pumping a pump medium from the inlet (3) to the outlet (4) and an impeller seat (10) are arranged in the pump housing (2).
In order to achieve a high degree of sealing and a long service life, the impeller seat (10) is formed in a ring-shaped impeller protector (8) which is made from a corrosion-resistant material and is received in the pump housing (2), wherein an insertion region (7) of the impeller (5) is radially surrounded by the impeller protector (8).
This impeller protector (8) protects the coating against damage to the impeller (5) in the impeller seat (10).

13 Claims, 3 Drawing Sheets

CENTRIFUGAL PUMP AND IMPELLER PROTECTOR FOR CENTRIFUGAL PUMP

FIELD OF THE INVENTION

The invention relates to a centrifugal pump and an impeller protector for such a centrifugal pump.

BACKGROUND ART

Centrifugal pumps are used for pumping pump media, which in general are fluids. The pump media enters the centrifugal pump through the inlet and is pumped through the rotation of the impeller to the pressure side and is output under pressure through the outlet. In many cases, the outlet is located radially with regard to the impeller, wherein a radial flow is generated by the impeller.

For a good efficiency of the pumps, sufficient sealing is required between the pressure side and the suction side. For this purpose, the impeller interacts with an impeller seat that is formed stationarily in the pump housing. In order to enable a movement of the impeller relative to the impeller seat, a sealing as complete as possible between the impeller and the impeller seat requires accurately fitting fabrication and, if necessary, additional sealing. This makes the production of the pump complicated and expensive.

Due to unavoidable manufacturing tolerances, unpleasant grinding noises can be heard which stop only after a certain running-in time. These grinding noises result from contact between the impeller and the impeller seat and cause material abrasion at least on one of these two elements. However, this results also in bypass connections, thus leaks, between the suction side and the pressure side. Also, replacing the impeller is relatively problematic since usually the new impeller does not correspond to the shape of the old impeller seat.

This can also result in damage to a coating of the pump housing or the impeller seat. This is in particular problematic if the centrifugal pump is used for corrosive fluids such as, for example, swimming pool water. After long downtimes, in the worst case, rust-induced seizing up of the impeller in the impeller seat can occur, which entails significant maintenance work or even requires complete replacement of the pump.

SUMMARY OF THE INVENTION

It is now an object of the invention to eliminate the disadvantages of the prior art and in particular to provide a solution by means of which the service life of a centrifugal pump can be prolonged and which is in particular maintenance-friendly, and which provides compensation for play and improves the efficiency of the centrifugal pump.

Thus, it is provided according to the invention to form the impeller seat in a ring-shaped impeller protector that is made from a corrosion-resistant material and is received in the pump housing, wherein an insertion region of the impeller is radially surrounded by the impeller protector.

The impeller seat, which through interaction with the impeller seals the pressure side of the pump from a suction side, is therefore not formed integrally in the pump housing and/or inserted here as an additional component in a fixed connection, as previously usual in the prior art, but is formed in an additional dynamic element, namely the impeller protector. The impeller protector can be manufactured with little effort and with relatively high accuracy of fit so that a dynamic compensation of play takes place between the impeller protector and the pump housing. In this manner, a gap between the impeller seat and the impeller can be kept very small so that high efficiency can be achieved. By using a corrosion-resistant material for the impeller protector, protection against corrosion is achieved so that an operation with long downtimes of the centrifugal pump is also possible without any problems, even when corrosive pump media are used. If due to signs of wear, replacement of the impeller and/or impeller seat is required, the impeller protector can be replaced in a relatively simple manner so that a maintenance-friendly centrifugal pump with a long service life is obtained. Via the impeller protector, a relatively great eccentricity can be compensated. This results in easier mounting of the pump with subsequent smooth running and a high degree of tightness.

It is particularly preferred here that the impeller is radially and axially guided in the impeller protector. Thus, the position of the impeller is very precisely predefined by the impeller protector. The impeller protector can comprise a radially inward protruding collar which, so to speak, serves as an axial end stop for the impeller and forms a portion of the impeller seat. Thereby, a long sealing gap and thus good sealing is obtained.

In a preferred configuration, the impeller rests with a front side against the end stop of the pump housing. The end stop can be formed, for example, as radially and circumferentially extending, inwardly protruding web of the pump housing against which the impeller protector rests. The axial position of the impeller protector within the pump housing is therefore clearly defined. At the same time, with the impeller protector resting against the end stop, a first sealing between the pump housing and the impeller protector is already obtained. Thereby it is prevented that the pump medium bypasses the impeller protector.

Preferably, the front side of the impeller protector is chamfered or rounded at least at a radial outer edge. This makes inserting the impeller protector into the pump housing easier. In addition, this has manufacturing-related advantages since geometrical over determinacy between the pump housing and the impeller protector is avoided.

In a particularly preferred configuration, the impeller protector comprises a plastic material, in particular polyoxymethylene (POM) or polytetrafluoroethylene (PTFE). Suitable as a plastic material are in particular thermoplastic plastics. Such plastics possess high thermal stability and absolute corrosion resistance. Moreover, plastics exhibit less water absorption and can be processed in a simple manner. POM and PTFE are characterized by high strength, sufficient hardness and stiffness, and exhibit high abrasion resistance and a low friction coefficient. Between the impeller and the impeller seat or the impeller protector, a friction pairing can then be formed in which the impeller slides on the impeller seat or an inner side of the impeller protector. Due to the material of the impeller protector, only minor friction losses occur which play only a minor role with regard to the advantages achievable through good sealing between the impeller seat and the impeller. Overall, a centrifugal pump with very high efficiency is obtained in this manner.

For sealing and dynamic movement compensation between the impeller protector and the pump housing, a radial seal can be arranged between the impeller protector and the pump housing. The radial seal is usually formed as a ring seal and prevents a bypass connection or leakage between the impeller protector and the pump housing, even if the impeller protector has radial play, thus is movable with respect to the pump housing.

It is particularly preferred here that the radial seal has a sealing lip that is inclined with respect to an axial direction and rests with a suction-side surface against the pump housing or the impeller protector. On the one hand, this sealing lip, for example a "Viton rubber lip" serves for compensating the play between the impeller protector and the pump housing, and, on the other, for reliable sealing. With the inclined formation of the sealing lip it is achieved that by the pressure of the pump medium on the pressure side, the sealing lip is pressed against the pump housing or the impeller protector so that with increasing pressure, the sealing effect of the seal is improved at the same time. A radial gap between the pump housing and the impeller protector, which gap, for example, is advantageous for compensating the play, can then be covered by the radial seal with the sealing lip without any problems so that sufficient centering between the impeller and the pump housing or the impeller protector is possible.

For securing the position in the axial direction, the radial seal can be held in an annular groove which is in particular formed in a circumferential surface of the impeller protector. Such an annular groove can be generated in a relatively simple manner, and when inserting the impeller protector into the pump housing, for example, it provides already for a defined position of the radial seal. Assembling the centrifugal pump is therefore simplified.

Preferably, a groove opening of the annular groove is smaller than the groove bottom, wherein the annular groove has in particular side flanks that are inclined toward each other. Thereby, the radial seal is held in the annular groove by means of a form-locking connection. At the same time, a high degree of sealing is obtained between the radial seal within the annular groove.

Preferably, the radial seal between the impeller protector and the pump housing is preloaded. The radial preload can be generated, for example, by deforming the sealing lip. Thereby, a friction-locked fit of the impeller protector in the pump housing can be generated. At the same time, the preload of the radial seal ensures sufficient sealing even in cases where the impeller protector is slightly offset with respect to the pump housing so as to compensate the play. A radial air gap between the pump housing and the impeller protector is therefore reliably sealed by the radial seal.

The aforementioned object is achieved by an impeller protector that is ring-shaped and comprises a corrosion-resistant material, in particular plastic, wherein an impeller seat for an impeller is formed in the impeller protector. The configurations explained in connection with the centrifugal pump and the resulting advantages also apply analogously, of course, to the impeller protector.

BRIEF DESCRIPTION OF THE DRAWINGS

Further features, details and advantages of the invention arise from the following description of exemplary embodiments based on the drawings. In the figures.

DETAILED DESCRIPTION OF THE INVENTION

Figure 1:
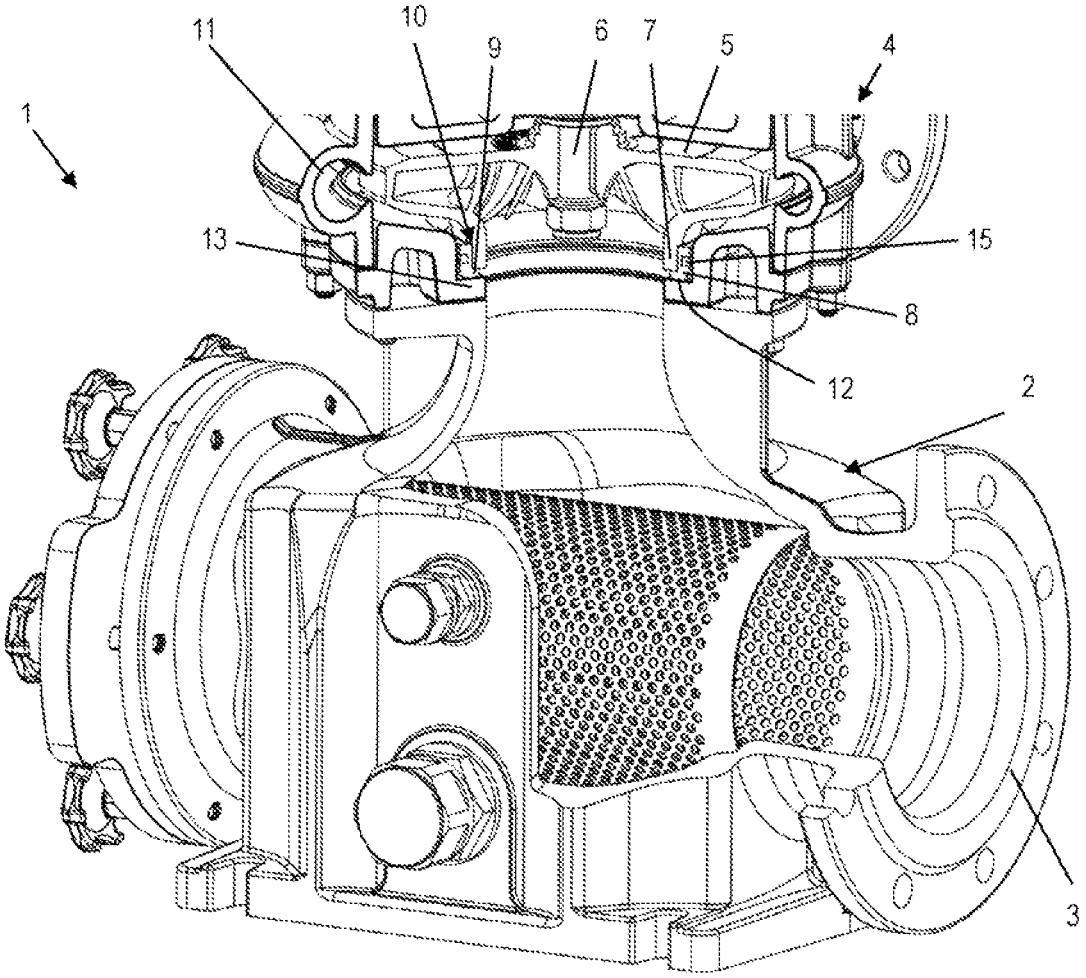
FIG. 1 shows a centrifugal pump in partially cut, spatial illustration.

FIG. 1 shows a centrifugal pump 1 with a multi-part pump housing 2. The pump housing 2 has an inlet 3 and a radial outlet 4. An impeller 5 which is connected to a motor shaft 6 is rotatably held within the pump housing 2.

An insertion region 7 of the impeller 5 extends into a ring-shaped impeller protector 8. The impeller protector 8 has a radially inward facing circumferential collar 9 and forms an impeller seat 10 for the impeller 5. For this purpose, the impeller 5 is slidingly guided in the impeller seat 10 or on the inner surfaces of the impeller protector 8 so that the pump medium such as, for example, swimming pool water that is pumped from the inlet 3 to the outlet 4 cannot flow between the impeller protector 8 and the impeller 5, but is radially carried along by the impeller 5 and thereby gets into a pressure channel 11 and from there to the outlet 4.

The impeller 5 is radially and axially guided with regard to the pump housing 2 by the impeller protector 8. In addition to centering and to compensating a play, the impeller protector 8 also enables good sealing between the suction side and the pressure side and, at the same time, only minor friction losses. Here, the impeller protector 8 is formed from plastic such as, for example, POM or PTFE and, accordingly, is corrosion-resistant. Therefore, there is no concern for rust-induced seizing up of the impeller 5 in the impeller seat 10, not even during long downtimes.

The impeller protector 8 rests with a front side 12 against an end stop 13 of the pump housing 2, which end stop is formed by a radially inward protruding circumferential web of the pump housing 2. Thus, the axial position of the impeller protector 8 within the pump housing 2 is determined by a form-locking connection. In this manner it is achieved that the impeller protector 8 rests in a secure and tight manner against the pump housing 2.

Figure 2:
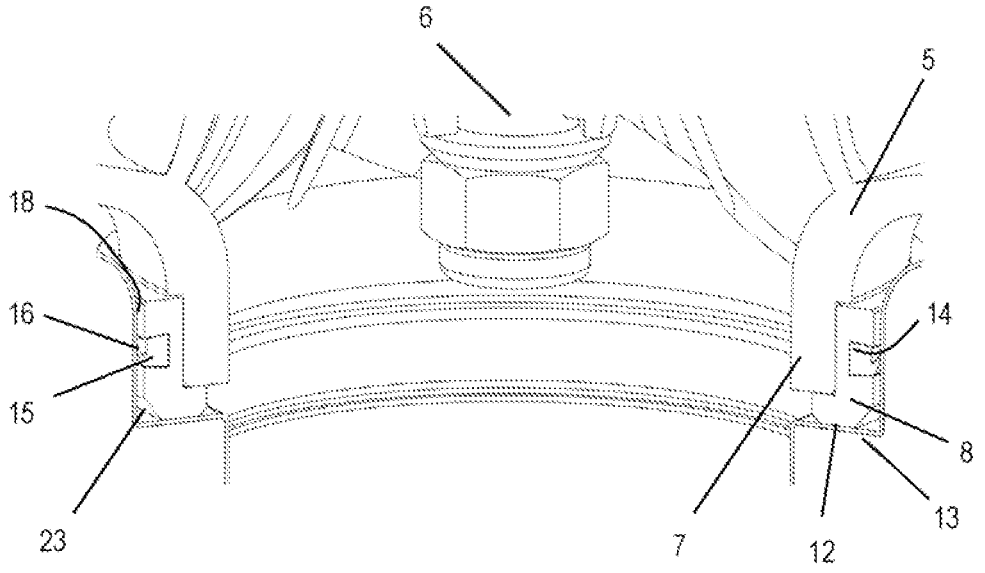
FIG. 2 shows a cut-out from FIG. 1.

FIG. 2 illustrates in an enlarged view the arrangement of the impeller protector 8 within the pump housing 2 and the impeller 5. The impeller seat 10 is the contact surface between the insertion region 7 of the impeller 5 and a radial inner side of the impeller protector 8 with an axial upper side of the collar 9. Thereby, a relatively large contact area is obtained, through which good sealing is achieved. At the same time, friction is kept low by the material used for the impeller protector 8 so that overall a high degree of efficiency can be achieved.

A radial seal 15 that radially seals the impeller protector with respect to the pump housing 2 is arranged in an annular groove 14 of the impeller protector 8. On its radial outside, the radial seal 15 has a sealing lip 16 which rests with a suction-side surface 17 against the pump housing 2. Thus, the sealing lip 16 extends at an angle relative to the axial direction of the motor shaft 6. Thereby, a gap 18 is bridged by the radial seal 15 or the sealing lip 16, which gap is annularly formed between the impeller protector 8 and the pump housing 2. Thus, the impeller protector 8 can be aligned with regard to its radial position within the pump housing 2 and therefore can compensate tolerances between the position of the impeller 5 and the pump housing 2. As a result, the impeller protector 8 can always be accurately centered with respect to the impeller 5. By radially bracing the radial seal 15 between the impeller protector 8 and the pump housing 2, a holding force can be generated by the radial seal 15. This results in a friction-locked fastening of the impeller protector 8 in the pump housing 2.

Figure 3:
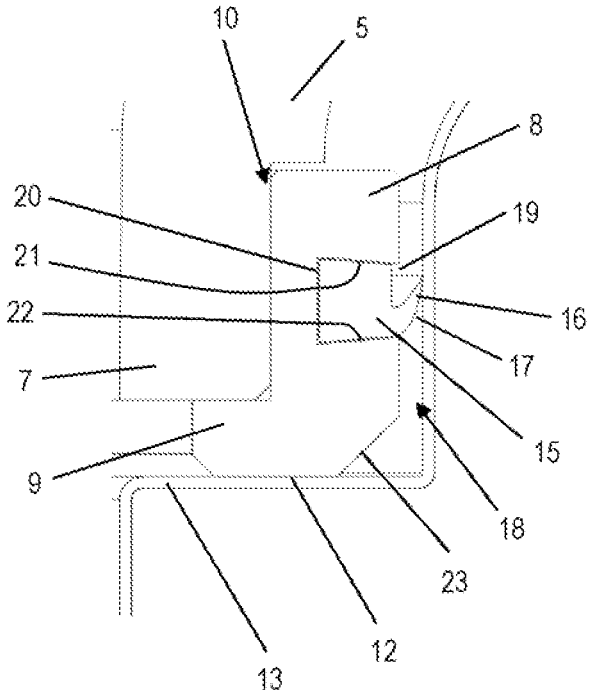
FIG. 3 shows a detail from FIG. 2.

As is shown in particular in FIG. 3, a groove opening 19 is smaller than a groove bottom 20. This is achieved through side flanks 21, 22 of the ring groove 14 which are inclined toward each other. Through this, the radial seal 15 can be received within the annular groove 14 in a form-locking manner so that the position of the radial seal 15 with respect to the impeller protector 8 is clearly defined. Also, a large sealing area is obtained between the radial seal 15 and the impeller protector 8, and thus good sealing is achieved.

A radial outer edge 23 of the front side 12 of the impeller protector 8 has a chamfer which makes inserting the impeller protector 8 into the pump housing 2 easier. In addition, geometrical over determinacy is avoided in this manner.

Figure 4:
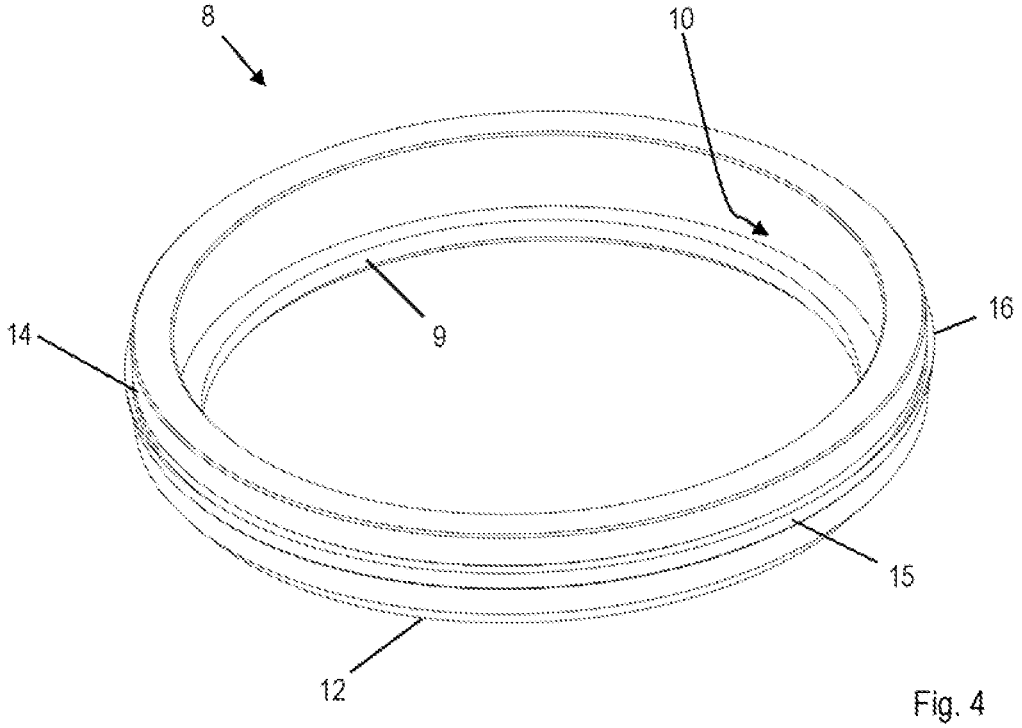
FIG. 4 shows an impeller protector in a spatial illustration.

FIG. 4 shows the impeller protector 8 in a three-dimensional illustration. The radial seal 15 is received in the annular groove 14 which is formed in the circumferential surface of the impeller protector 8. The circumferentially extending collar 9, which represents a portion of the impeller seat 10, is assigned to the front side 12 so that a sufficient guide surface within the impeller protectors is available for the impeller 5 in the radial and axial directions.

Through the impeller protector, flexible sealing of the impeller seat, thus with respect to the impeller, is obtained. This leads to maximum sealing, wherein disadvantageous bypasses between a pressure side and a suction side are avoided. At the same time, this provides wear protection since a coating of the pump housing is protected by the impeller protector. Direct contact between the impeller and the pump housing is avoided due to the impeller protector. With the impeller being slidingly mounted, the impeller protector enables an impeller movement with very low friction. In addition, rust-induced seizing up of the impeller in the pump housing is prevented by producing the impeller protector from a rustproof material such as, for example, a plastic material. By a radial seal, in particular with a sealing lip, a high degree of tightness is also achieved between the impeller protector and the pump housing, wherein compensation of play is ensured at the same time.

Through the impeller protector, almost wear-free rotating of the impeller within the pump housing is achieved, wherein the pump housing can be completely coated. Because of the good sealing, the efficiency of the pump is improved once again. Another advantage arises during maintenance of the centrifugal pumps. For example, by replacing the impeller protector, a simple replacement of the impeller seat is possible without coated surfaces of the pump housing getting damaged. Also, no unpleasant grinding noises occur during a first start-up, but instead, a quiet and pleasant operation is achieved.

The centrifugal pump according to the invention can also be used with corrosive pump media such as, for example, swimming pool water. It is possible here to produce the pump housing as a gray iron casting and to coat all surface that come into contact with the pump medium so that good protection of the gray iron material, which as such is susceptible to corrosion, is achieved. Thus, the range of use of these pumps is significantly expanded.

REFERENCE LIST

1 Centrifugal pump
2 Pump housing
3 Inlet
4 Outlet
5 Impeller
6 Motor shaft
7 Insertion region 7
8 Impeller protector
9 Collar
10 Impeller seat
11 Pressure channel
12 Front side
13 Web
14 Annular groove
15 Radial seal
16 Sealing lip
17 Suction-side surface
18 Gap
19 Groove opening
20 Groove bottom
21 Side flank
22 Side flank
23 Outer edge

The invention claimed is:

1. A centrifugal pump (1) comprising a pump housing (2) that has a suction-side inlet (3) and at least one pressure-side outlet (4), wherein a rotatably mounted impeller (5) for pumping a pump medium from the inlet (3) to the outlet (4) and an impeller seat (10) are arranged in the pump housing (2), characterized in that the impeller seat (10) is formed in a ring-shaped impeller protector (8) which is made from a corrosion-resistant material and is received in the pump housing (2), wherein an insertion region (7) of the impeller (5) is radially surrounded by the impeller protector (8), and further wherein a radial seal (15) is arranged between the impeller protector (8) and the pump housing (2).

2. The centrifugal pump according to claim 1, characterized in that the impeller (5) is radially and axially guided in the impeller protector (8).

3. The centrifugal pump according to claim 1, characterized in that the impeller protector (8) has a radially inward protruding collar (9).

4. The centrifugal pump according to claim 1, characterized in that the impeller protector (8) rests with a front side (12) against an end stop (13) of the pump housing (2).

5. The centrifugal pump according to claim 4, characterized in that the front side (12) of the impeller protector (8) is chamfered or rounded at least at one outer edge (23).

6. The centrifugal pump according to claim 1, characterized in that the impeller protector (8) comprises a plastic material.

7. The centrifugal pump according to claim 1, characterized in that the radial seal (15) has a sealing lip (16) which is inclined with respect to an axial direction and rests with a suction-side surface (17) against the pump housing (2) or the impeller protector (8).

8. The centrifugal pump according to claim 1, characterized in that an annular groove (14), in which the radial seal (15) is held, is formed in a circumferential surface of the impeller protector (8).

9. The circumferential pump according to claim 8, characterized in that a groove opening (19) of the annular groove (14) is smaller than a groove bottom (20), wherein the annular groove (14) has in particular side flanks (21, 22) which are inclined toward each other.

10. The centrifugal pump according to claim 1, characterized in that the radial seal (15) is preloaded between the impeller protector (18) and the pump housing (2).

11. An impeller protector for a centrifugal pump according to claim 1, which impeller protector is ring-shaped and comprises a corrosion-resistant material, wherein an impeller seat (10) for an impeller is formed in the impeller protector (8).

12. The centrifugal pump according to claim 6, wherein the plastic material is polyoxymethylene or polytetrafluoroethylene.

13. The impeller protector for a centrifugal pump according to claim 11, wherein the corrosion-resistant material is plastic.

* * * * *